US007335074B2

(12) United States Patent
Arneson

(10) Patent No.: US 7,335,074 B2
(45) Date of Patent: Feb. 26, 2008

(54) SHROUD ENCLOSED INVERTED SURFACE PIERCING PROPELLER OUTDRIVE

(76) Inventor: Howard Arneson, 18 Sagebrush Ct., San Rafael, CA (US) 94901

( * ) Notice: Subject to any disclaimer, the term of this patent is extended or adjusted under 35 U.S.C. 154(b) by 0 days.

(21) Appl. No.: 11/159,420

(22) Filed: Jun. 21, 2005

(65) Prior Publication Data

US 2007/0010144 A1 Jan. 11, 2007

(51) Int. Cl.
*B63H 1/28* (2006.01)
*B63H 5/14* (2006.01)

(52) U.S. Cl. ..... 440/66

(58) Field of Classification Search ..... 440/66, 440/67, 71

See application file for complete search history.

(56) References Cited

U.S. PATENT DOCUMENTS

| | | | | |
|---|---|---|---|---|
| 2,985,133 | A * | 5/1961 | Shaffer | 440/71 |
| 3,455,268 | A * | 7/1969 | Gordon | 114/166 |
| 3,742,895 | A | 7/1973 | Horiuchi | |
| 3,768,432 | A | 10/1973 | Spaulding | |
| 3,793,980 | A * | 2/1974 | Sherman | 440/69 |
| 3,933,116 | A * | 1/1976 | Adams et al. | 440/57 |
| 4,031,846 | A | 6/1977 | Tone | |
| 4,544,362 | A | 10/1985 | Arneson | |
| 4,645,463 | A | 2/1987 | Arneson | |

(Continued)

FOREIGN PATENT DOCUMENTS

DE 3042197 A1 6/1982

OTHER PUBLICATIONS 5,207,605 was incorrectly cited as 5,270,605 in the office action mailed Sep. 5, 2006. This is a corrected notice of references cited for the office action mailed Sep. 5, 2006.*

*Primary Examiner*—Sherman Basinger
(74) *Attorney, Agent, or Firm*—Townsend and Townsend and Crew LLP

(57) ABSTRACT

A shrouded outdrive propels a high-speed boat having a hull for high-speed passage through water. The hull has at least one bow at the forward end and at least one transom at the stern. A tubular shaft extends at a small angle (6° to 12°) from the boat transom into the water, and a drive shaft is arranged within the tubular shaft. A propeller is mounted to the drive shaft for partial immersion in the water so that a lower portion of the propeller extends into the water during high-speed floating passage of the boat and a upper portion of the propeller is above the water during high-speed floating passage of the boat. A shroud is arranged about the propeller and is disposed below the water and adjacent the propeller. A mount holds the shroud to form a shroud-enclosed channel during high-speed passage of the boat through the water in which the propeller rotates. A plate horizontal to the undisturbed passing water surface overlies the departure side of the propeller at a radial distance of about two thirds (⅔) of the radius of the propeller. This plate immediately abuts the departure blading of the propeller in the direction of boat movement through the water and assures immersion of the lower pitch departure side of the partially immersed propeller in water for more efficient propulsion. Embodiments are disclosed where the plate is utilized as the necessary support for the shroud. Additionally, both the shroud and the plate can have small angular variations with respect to the surface of the undisturbed surface through which the high-speed hull passes.

14 Claims, 8 Drawing Sheets

U.S. PATENT DOCUMENTS 4,746,314 A 5/1988 Levi
4,808,132 A 2/1989 Douglas
4,909,175 A 3/1990 Arneson
5,066,255 A 11/1991 Sand
5,207,605 A * 5/1993 Kroeber ..... 440/71
5,270,605 A * 12/1993 Lefrancois et al. ..... 310/263
5,667,415 A 9/1997 Arneson
6,059,618 A 5/2000 Purnell et al.

* cited by examiner

SHROUD ENCLOSED INVERTED SURFACE PIERCING PROPELLER OUTDRIVE

This invention relates to outdrives for boats having partially immersed surface piercing propellers. More particularly, a high speed boat is provided with a surface piercing propeller enclosed within an inverted shroud which effectively defines a channel isolating the propulsion effects of the outdrive from extraneous torques common in surface piercing propeller outdrives. Moreover, an overlying plate improves propeller performance on the departure portion of the propeller blading from the partially immersed propeller.

It will be understood that the outdrive disclosed herein is applicable to all planing hulls—usually proceeding at speeds in excess of 18 mph. This disclosure relates to patrol boats, yachts, mega yachts, and so-called speed boats. Regarding ski boats, it is to be understood that the outdrive herein generates a "rooster tail", a stream of airborne elevated water propelled by the propeller immediately astern of the outdrive. For that reason, the outdrive is not generally acceptable to ski boats.

In the following discussions, testing of the outdrive will be referred to high horsepower (4,000 hp), high speed drives (160 mph speed with propeller at 6,000 to 7,000 rpm). These powers and speeds have been used for the testing of the drive. The principles set forth here are applicable at much lower powers and speeds so long as a partially immersed propeller is utilized with a planing hull at speeds in excess of 18 mph.

BACKGROUND OF THE INVENTION

In my Arneson U.S. Pat. No. 5,667,415, there is disclosed a surface piercing propeller enclosed within a metal shroud. The shroud extends over the top of the surface piercing propeller in all embodiments illustrated.

In Arneson U.S. Pat. No. 5,667,415, the water churned upwardly by the rotation of the propeller is deflected by the overlying shroud. The interaction of the overlying shroud with the blade tends to reduce the turbulence overlying the propeller. The instabilities of the boat arising from stern lift and bow immersion of the outdrive propeller are substantially reduced. Moreover, the operator finds it much easier to operate the controls of the boat since the overlying shroud acts as a partial barrier for lateral movements of the water which tend to cause the propeller to "walk" to one side of the vessel, exerting a turning force on the boat relative to the water.

The elimination of the instabilities associated with the shroud thereon clearly utilizes the positions of the inner surfaces of the shroud. The shroud is typically far enough away from the plane of rotation of propeller so as to prevent interference by the shroud to the rotation of the propeller itself as well as the shroud being drawn into the propeller. The inner surfaces of the shroud members also contribute to keeping the center shaft thrust direction stable so that there is reduced tendency for the propeller to lift out of the water and cause the operator of the boat to fight the steering and trim gears of the boat. The propeller configuration is different from standard propeller units. The propeller is smaller in diameter with wide thick blade tips that make it very strong and efficient. This allows the boat to get on plane quickly and with ease and maintains the achieved plane even when the rpms of the system are decreased (conventional boats tend to fall off plane when this occurs).

Discovery

I routinely have conducted extensive testing of outdrives in San Francisco Bay and elsewhere. As a result of this extensive testing, and through careful examination of a number test models—exceeding 100 in the last 5 years, I have made several important discoveries. The reader will understand that discovery can constitute invention by itself. More often, discoveries lead to the definition of problems to be solved. Once the problems are identified, further work can lead to the solution of those problems. Accordingly, I claim invention relative to the following discoveries, identification of problems, as well as to the solution to those problems.

First, I have discovered that the propeller characteristics of an outdrive propeller proceeding through the water at high speed are surprising and not obvious, even after thousands of hours of testing. In order to understand these discoveries, it is necessary to review the fundamentals of out drives.

A typical out drive trails the transom of a high speed planing hull. The outdrive propeller is typically immersed below the surface of the water from the center of rotation of the propeller to immerse just the lower half of the propeller within the water, presuming that the water is undisturbed. The shaft of the propeller extends from the transom downward at an angle with respect to the surface of the undisturbed water when the high speed planing hull is on plane. This has the beneficial result of keeping the most of the shaft of the outdrive out of the water. Typically, this angle can be from 6° to 12°. I will use 6° in the following examples.

The shaft of typical outdrive is typically of large diameter. It includes an outer tubular housing and an inner rotating shaft to supply rotational power to the propeller. Typically, the driving shaft is supplied with two sets of bearings. A first bearing adjacent is a universal joint on the shaft with the universal joint enabling the shaft to be "steered." The second bearing is immediate the propeller at the distal end of the shaft from the boat. Having the shaft extend from the transom of the boat, downward at an angle of 6° to 12° from the horizontal, the major part of the shaft and surrounding tubular member is kept from having to be dragged through the water. This saves considerable friction with respect to the water and this angular disposition of outdrives is universally used.

In the following description, I am going to use the definition "working surface" to describe an arbitrarily selected portion of a propeller blade. I will select this arbitrary "working surface" by measuring radially outward of the blade of a propeller, here a 14 inch diameter propeller. The radial distance that I will choose is 5 inches. I will take measurement of the angle of the working surface tangent to the rotation of the propeller.

The reader will understand the reason for this arbitrary definition. Specifically, propeller blades have changing working blade angles from the hub of the propeller to the extremity of the blades. In the usual case, the pitch is high adjacent the hub and gradually decreases as that pitch is measured radially outward. By having a "working surface" (pitch chosen on an arbitrary radial tangent to the direction of propeller rotation), it is possible to generate a convenient working definition of propeller pitch in angle with respect to the shaft. Using this definition, some of the working principles of this invention can be more easily understood.

I have discovered that the 6° downward disposition of the outdrive shaft has the effect of producing variable pitch propeller blading on opposite sides of the partially immersed propeller! Specifically, this may be seen by taking a representative "working surface" on the surface of a propeller. Say on a 14 inch diameter propeller, this chosen "working surface" happens to be in the middle of a propeller blade at a distance of 5 inches of radius from the center of rotation of a propeller having a 7 inch radius (or 14 inch diameter). Placing a level device along the "working surface" tangent to the direction of propeller rotation and measuring the angle of the "working surface" with respect to the outdrive shaft will yield a constant angle of the working surface with respect to the shaft. Say for example this angle is 54°. So at any position of rotation of the "working surface" with respect to the shaft, this angle will always be the same, that is 54° with respect to a plane including the axis of the drive shaft of the propeller.

But everyone forgets that the propeller shaft itself is at an angle! Say that angle is 6° with respect to the horizontal when the boat is planing at high speed. I have discovered that this produces variable propeller pitch on opposite horizontal sides of the propeller! As these variable propeller pitches are integral to the shrouding that I place around my improved outdrive, the variable pitches must be understood.

As is well known, most single propellers rotate counterclockwise following the well known "right hand rule." By extending the right hand thumb in the direction of the propeller shaft, the fingers when naturally curled give the direction of rotation of the propeller. Where two propellers are used, one propeller rotates counterclockwise and the other propeller clockwise. And since both type of propellers are always a possibility in an outdrive propeller, I choose to talk about the working surfaces of the propeller entering the water and the working surfaces of the propeller leaving the water, regardless of whether the propeller right or left hand rotation.

As will be shortly developed, the entry pitch of the working surface (angle of attack with respect to the passing undisturbed water) is increased upon entry into the water by the angle of the shaft with respect to the water. Similarly, the departure pitch of the working surface is decreased upon departure from the water by the angle of the shaft with respect to the water. This discovery is an important consideration in the design that follows.

Consider the case of the entry pitch of the working surface. As we have previously developed, the working surface has a 54° angle with respect to the propeller shaft. But the propeller shaft is inclined at 6°. Adding this 6° to 54°, the angle of attack of the entry pitch of the working surface with respect to the undisturbed water though which the propeller passes upon entry into the undisturbed water level now becomes 60°!

Consider the case of the departure pitch of the working surface. Again the working surface has a 54° angle with respect to the propeller shaft. But the propeller shaft is inclined at 6°. Subtracting this 6° from 54°, the angle of attack of the entry pitch of the working surface with respect to the undisturbed water through which the propeller blade passes upon departure from the undisturbed water level now becomes 48°!

The important thing to understand, is that with an outdrive having shaft inclined from the horizontal by a small angle (here 6°), the entry pitch of any working surface on a blade is higher that the departure pitch of any working surface on the blade by the value of the shaft inclination.

Now let us talk about propeller "pitch" in general.

Where one wants rapid acceleration and high propeller output power, low pitches on propellers are desirable. For example, tug boat propellers have low pitch so that large vessels may be slowly moved. Similarly, sail boat auxiliary propellers have low pitch so that the boats may maneuver in adverse weather conditions (i.e. keeping off the rocks in heavy weather). Low pitch propellers are not intended for high speed.

Where one wants high speed, high pitches are desirable. For example, racing boat propellers have high pitch so that the racing boat can proceed at high speed. High pitch propellers are not intended for low speed.

Now let us talk about the practical effect of the pitch change in the partially immersed outdrive propeller. The entry half of the propeller has higher pitch than the departure half the propeller! So at low speed and upon acceleration, the departure pitch will be more ideal. Upon reaching higher speed, the entry pitch of the propeller will be more ideal.

It will be understood that the propellers I use in this disclosed outdrive rotate at high power and high speed; for example all of the applicable testing for this invention has been accomplished in a twin hull boat having a 4000 Hp Lycoming Gas Turbine Engine with propeller rotating speeds of 6,000 to 7,000 rpms. Propellers having mechanically variable pitches are not practicable.

Again, the reader should not confuse my testing of this outdrive with those minimal conditions necessary to make the outdrive operable. As I have emphasized, any planing hull proceeding at more than 18 mph will suffice. Further, power expended to do this can be relatively minimal. All that is needed is sufficient power to make the boat hull plane.

Having discussed my discovery of the variable pitch of an outdrive propeller, discussion of my discoveries about the disturbance of water by a propeller proceeding through the water at high speed now become relevant. In summary, I have discovered that where a boat is proceeding at high speed—say 160 mph, standing water is disturbed before the blade of the propeller passes through the standing water. In other words, there is a disturbance in advance of blade entry to the surface of the water! There is a well known disturbance after the blade passes through the water; any person standing at the stern of a propeller driven vessel and observing its wake recognizes this disturbance. It is not well known that disturbance occurs in the direction of boat travel in advance of the passage of the propeller blades through the water!

First, it may well be that shock wave transmit in water faster than the high speed (e.g. 160 mph) passage of the boat.

Second, the variable pitch phenomena related to outdrives also has an effect. Consider the following.

If a propeller is pulled through the water without rotation, the "windage" of the propeller will cause the propeller to rotate. This is a well known phenomena for sailors repairing large engines at sea on ships underway. Specifically, the shaft of the engine being repaired must be locked, and ship moved at slow speed to maintain steerage, otherwise the windage of the propeller will cause the engine under repair to rotate, creating an extraordinarily dangerous condition.

Now consider the case where the propeller is rotated at a speed which is "neutral" to the rate of the passing water. Other than displacement effects, the propeller will neither have windage nor a propulsive force.

In the usual case, the propeller is rotated to propel water at a considerably faster speed than actual passage of the boat through the water. The propeller has slippage with respect to the passing water that is essential to its propelling effect. Anyone who has observed the wake of a propeller propelled ship is familiar with this result.

Now consider the case of the outdrive of this invention. The entry side of the propeller has a higher pitch, driving the water at higher speed. The departure side of the propeller has lower pitch, driving the water at lower speed. In actual practical effect, both pitches will considerably exceed the rate of passage of the boat through the water. For example, where the boat is proceeding through the water at 160 mph, both the entry high pitch side of the propeller and the departure low pitch side of the propeller will drive water at speeds exceeding the 160 mile per hour speed of the boat.

But there will be another surprising effect. When the entry side of the propeller is compared to the departure side of the propeller; water build up in advance of the departure side of the propeller will be more pronounced than water build up in advance of the entry side of the propeller!

The reason for this water build up differential is directly related to the variable pitch between the departure and entry sides of the propeller. Specifically, since the departure side has lower pitch and moves water at the propeller more slowly, water buildup in advance of the departure of the partially immersed propeller blade will be greater. Similarly, since the entry side has higher pitch and moves water at the propeller more quickly, water buildup in advance of the entry of the partially immersed propeller blade will be lesser. As will hereafter be understood, I use the greater buildup of water on the departure side of the propeller to advantage. Specifically, I place a horizontal barrier at approximately two thirds (⅔) of the propeller radius directly overlying the departure side of the partially immersed propeller. This has the effect of keeping the low pitch departure side of the propeller immersed in water for more efficient propulsion.

Plates overlying propellers used in the prior art are known. So-called "cavitation" plates are an example. These plates, used for example over outboard propellers, prevent water "flashing" into steam (cavitation). As distinguished from my plate, these plates are over an entirely immersed propeller. In what follows, I show plates under to the top portion of the partially immersed propeller.

Further, I have used plates on outdrives on shrouds or fins, these plates being over the upper two thirds (⅔) of a propeller. However, these plates have been parallel to the shaft, and never parallel to the plane of the undisturbed water. These plates have the effect of directing reverse water jets at and over the transom of the boat to which they are attached, especially during coming up to speed or decelerating from speed.

Further, the plates have been separated by several inches (in the order of three to four [3 to 4] inches) in advance of the propeller. Plates with this spacing cannot cooperate with the accumulation of water in advance of the departure side of the propeller. Water in the gap between the propeller and plate is not controlled and cannot provide the improved propulsion of this disclosure.

I have further discovered that inversion of the shroud from the preferred embodiments shown in my Arneson U.S. Pat. No. 5,667,415 produces superior results. Specifically, I use an inverted or "upside down" shroud. The inverted shroud defines an enclosed operating channel for the surface piercing portion of the propeller which isolates the partially immersed propeller from imparting unwanted torques to high speed hulls driven by the disclosed outdrive. Stern uplift with bow immersion is avoided. Further, crawling or "helm" exerted to one or the other side of the boat is substantially reduced.

The "upside down" shroud renders the direction of propeller rotation essentially irrelevant as it forms a separate and isolated chamber from the remainder of the water that the boat is passing through. For example, whether a so-called "right hand propeller" or a "left hand propeller" is utilized is irrelevant. Further, the slope of the wake where propeller immersion occurs is not as important. The disclosed shroud has the effect of isolating what might otherwise undesired torques on the vessel propelled by my outdrive.

BRIEF SUMMARY OF THE INVENTION

A shrouded outdrive propels a high speed boat having a hull for high speed passage through water. The hull has at least one bow at the forward end and at least one transom at the stern. A tubular propeller shaft extends at a small angle (6° to 12°) from the boat transom into the water with a shaft within the tubular propeller shaft. A propeller is mounted to the shaft for partial immersion in the water whereby a lower portion of the propeller passes below and into the water during high speed floating passage of the boat and a upper portion of the propeller passes above the water during high speed floating passage of the boat. A shroud is disposed about the propeller with the shroud being disposed below the water and adjacent the propeller. A mount for the shroud holds the shroud around the propeller whereby the propeller operates within a shroud enclosed channel during high speed passage of the boat through the water. A plate horizontal to the undisturbed passing water surface is disposed overlying the departure side of the propeller at a radial distance of about two thirds (⅔) of the radius of the propeller. This plate immediately abuts the departure blading of the propeller and assures immersion of the lower pitch departures side of the partially immersed propeller in water for more efficient propulsion. Embodiments are disclosed where the plate is utilized as the necessary support for the shroud. Additionally, both the shroud and the plate can have small angular variations with respect to the surface of the undisturbed surface through which the high speed hull passes.

An advantage of the inverted shroud is that it effectively defines a channel in the water in which the partially immersed propeller can operate. Forces tending to cause the partially immersed propeller to "walk" or steer the boat by causing "helm" (steering bias) are controlled. Specifically, the shroud created channel isolates the outdrive from reacting with the water to either side of the propeller.

An additional advantage of the inverted shroud is that it provides a smooth acceleration of the watercraft to cruising speed. It is not accompanied by propeller spinning at high speed with propeller cavitation to the surrounding water. Further, at low planing speeds, the outdrive tends to maintain planing and does not allow the driven hull to "fall" off of the plane and into the water in a displacement mode.

Further, the inverted shroud can itself be adjusted in pitch, either with the angle of the outdrive or independent of the angle of the outdrive. This adjustment in pitch of the shroud can trim lifting forces on the hull of the high speed boat being propelled by the outdrive. In the usual case, adjustments in shroud trim will be made to avoid undue stern lift and reactive pressure pushing the bow of the high speed boat into the water.

An advantage of the plate overlying the departure side of the partially immersed outdrive propeller blading is that it confines water over the departure blading at a level well above the "undisturbed" water line. Propeller blades, departing a plane above the normal water line, pass through a layer of water that is elevated above the plane of where the water would be, if it was undisturbed. In such passage, it is possible for the "lower pitch" departure blading to exert a propelling effect on the water.

An advantage of this propelling effect of the low pitch portion of the departure propeller blading is two-fold. First, this portion of the blading accounts for the superior acceleration characteristics of this outdrive design. When the boat is accelerating, the low pitch of the departure blading apparently adds acceleration. I rate this acceleration extraordinarily high over many comparable designs that I have tested.

Second, even when the boat is at full (high) speed, I find that the "low pitch" portion of the propeller is much more efficiently utilized. Being that the low pitch portion of the propeller has an increased "dwell time" in the passing water, the propulsion contribution of the low pitch departure blading is increased by the overlying plate.

It will also be understood, that this overlying plate operates parallel to the surface of the undisturbed water. Slight angles of inclination (much less than the 6° to 12° inclination of the propeller shaft) can be applied to the plate. These angles of inclination will be independent of the shaft and the shroud and again can be used to fine tune forces tending to either lift or depress the outdrive at the stern of the boat.

A further advantage of both the plate and the inverted shroud is that it provides the propeller with protection. While debris can conceivably be introduced into the interstices between the propeller, plate and inverted shroud, in the usual case debris will be deflected. In most cases, debris not deflected will be pulverized.

DETAILED DESCRIPTION OF THE INVENTION

Figure 1:
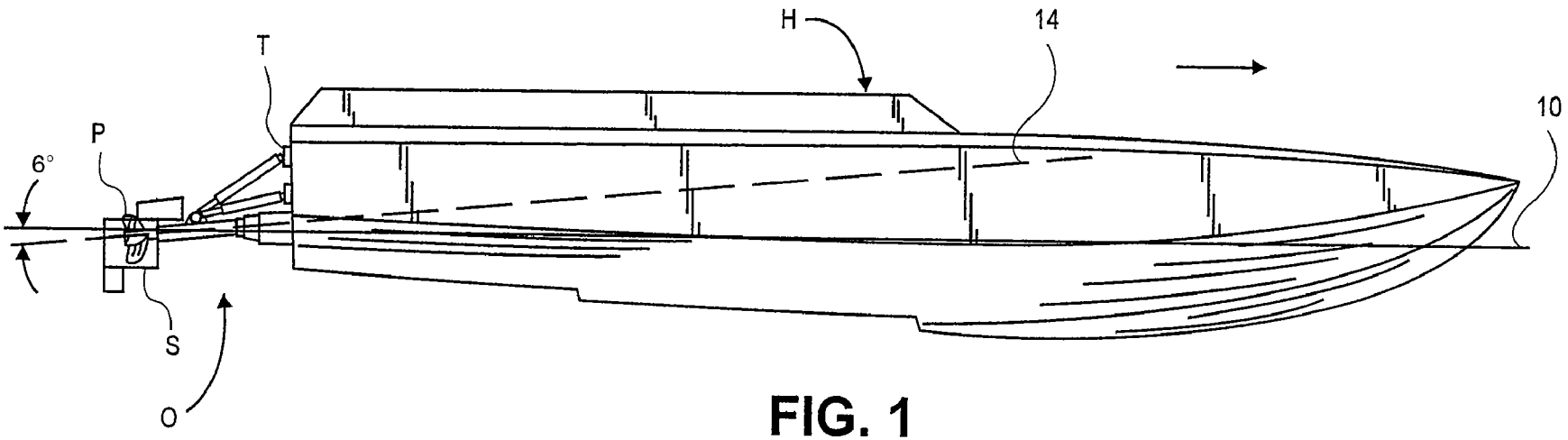
FIG. 1 is a side elevation of the boat illustrated in FIG. 1 of my Arneson U.S. Pat. No. 5,667,415 entitled "Marine Outdrive with Surface Piercing Propeller and Stabilizing Shroud," this boat now being fitted with the outdrive of this disclosure.

Referring to FIG. 1, high speed planing hull H having transom T has outdrive O. Hull H passes over water having upper surface 10. Outdrive O has partially immersed propeller P surrounded by shroud S which below, around and adjacent the propeller.

Referring further to FIG. 1, the most important thing to note is the angle between the plane of upper surface 10 of the water and centerline 14 of outdrive O shaft. Specifically, outdrive O has an angle of 6° with respect to upper surface 10. This angle can vary. In a wide range, this angle can be from 3° to 12°. In a narrower range, this angle can be from 4° to 9°. Here it is illustrated at the preferred angle of about 6°. Further, it will be understood that these angles are taken when the hull H is underway in a planing disposition at air speeds in the range of 30 mph to 160 mph. I avoid air speeds above 160 mph because of the danger of hull H becoming airborne.

Hull H is on the order of 50 feet in length with a displacement of 8,000 pounds. It is driven by a Lycoming gas turbine engine outputting 1,250 HP. At speeds approaching 160 mph, propeller P turns at speeds in the range of 6,000 to 7,000 rpms. Propeller P is typically of modified construction. Specifically, I buy a 22 inch propeller manufactured by the Rolla SP Propellers SA of Balerna, Switzerland. Thereafter, for the application here, I have the blades truncated so that they are about 14 inches in diameter. Over conventional outdrives, it will be understood that the blading here illustrated is truncated; the propeller shape is accurately represented in the attached drawings.

Brief reference will now be made to FIGS. 3A, 3B and 3C. Referring to FIG. 3C, hull H is shown with outdrive O protruding from transom T. A tubular propeller shaft 20 has an inner drive shaft 22. Drive shaft 22 extends between universal joint 24 adjacent transom T and propeller bearing 26 adjacent propeller P. Drive shaft 22 is co-axial to centerline 14.

Figure 3A:
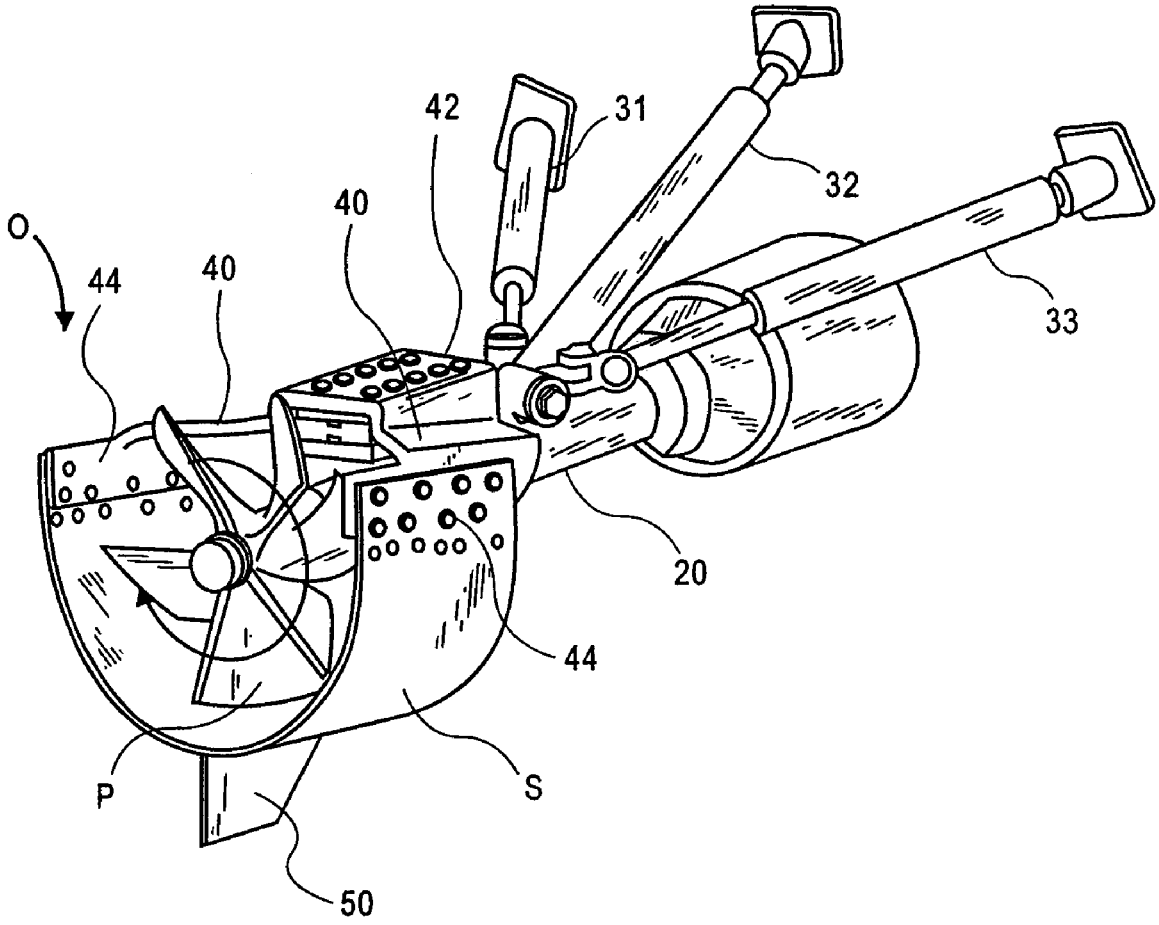
FIG. 3A is a perspective taken looking toward the transom of a boat having an outdrive according to this invention illustrating the mounting with a flat plate, five bladed propeller, and hydraulic cylinder support for steering the outdrive.
Figure 3B:
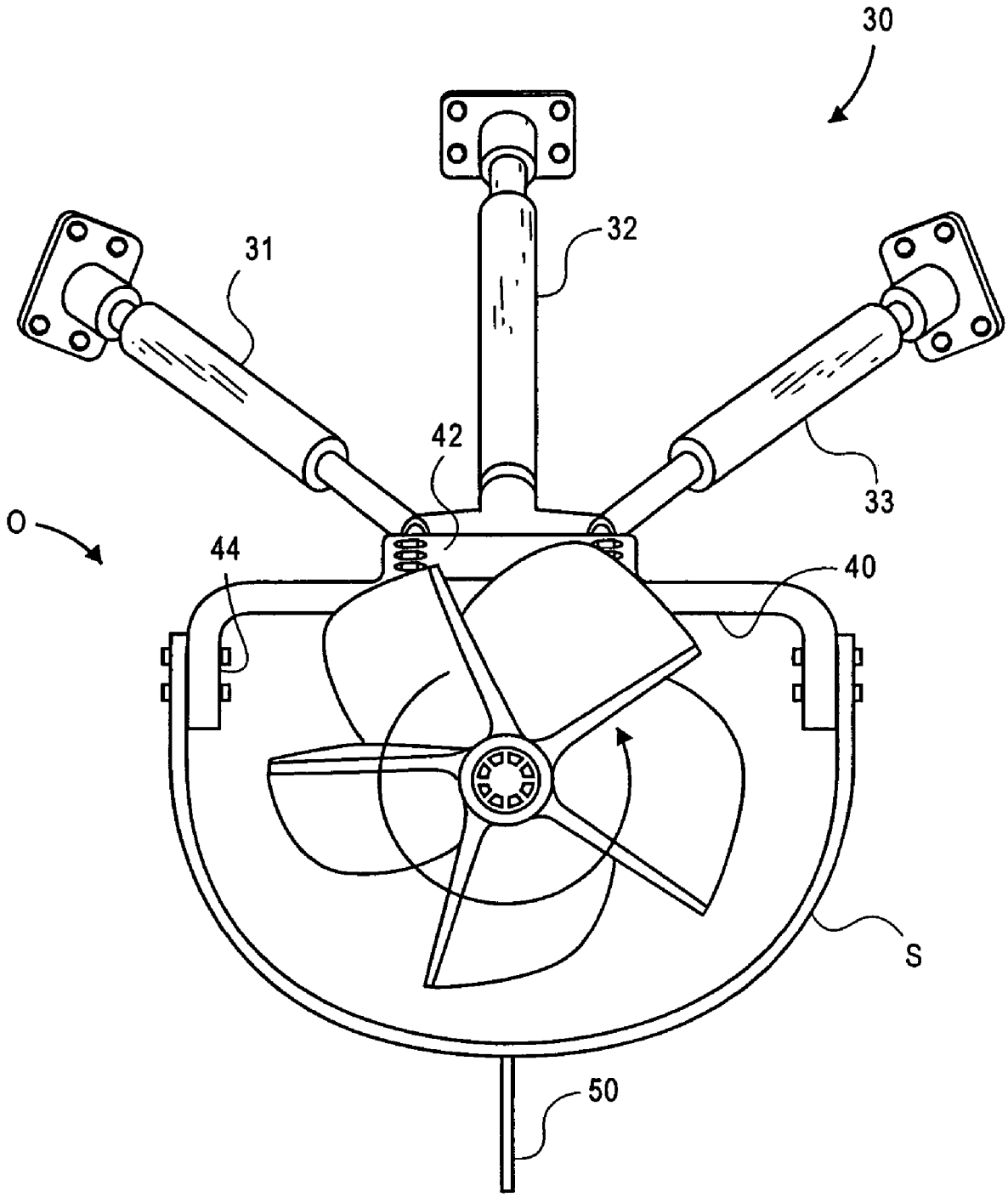
FIG. 3B is an end elevation of a propeller with underlying shroud shown in FIG. 3A showing the propeller with the departing blades raising the water level in advance of the passage of the propeller with the overlying plate parallel to the surface of the water confining the water below the departing blades to enable efficient drive from the departing blade side of the propeller.
Figure 3C:
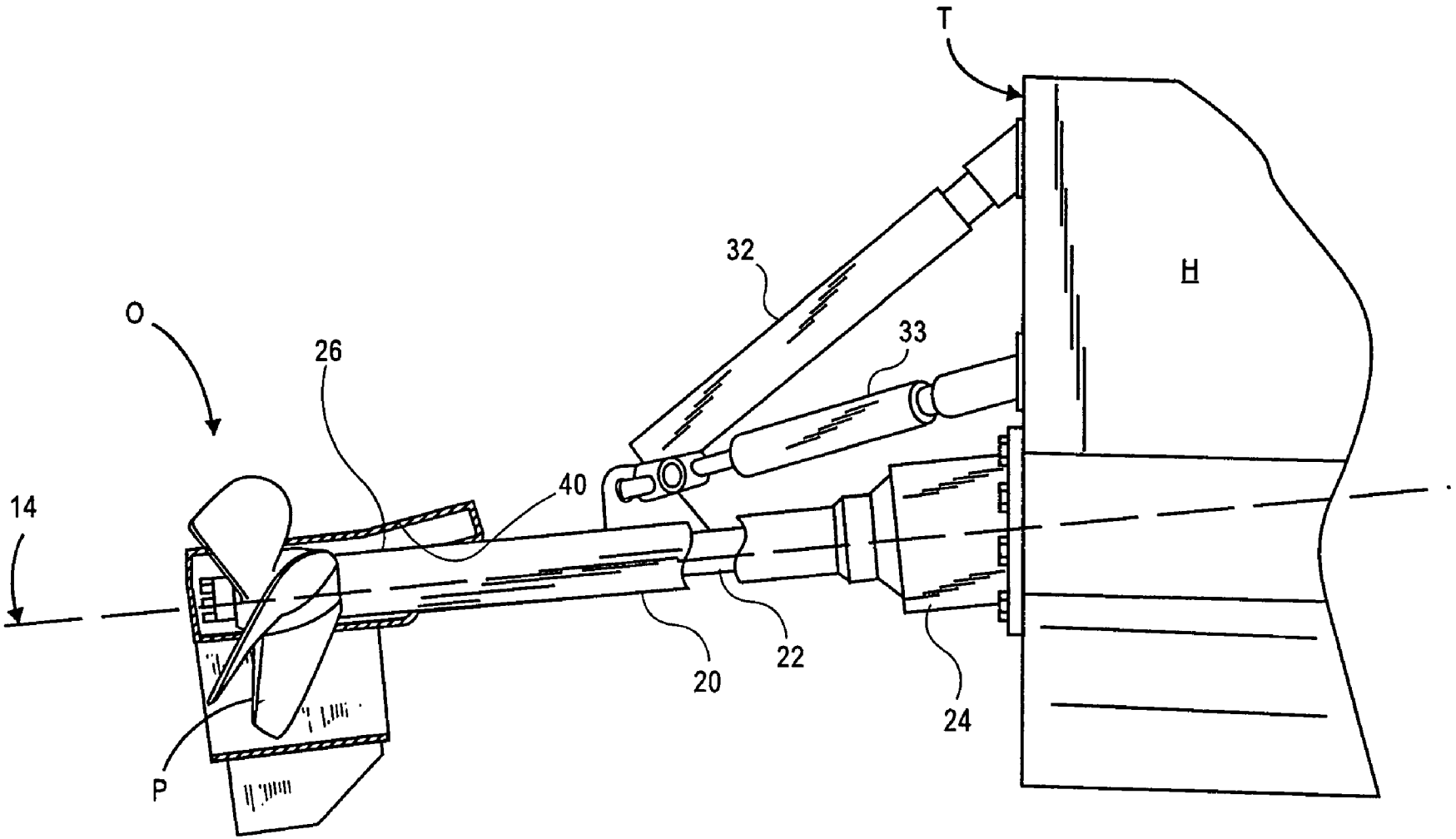
FIG. 3C is a side elevation along lines 3C-3C of FIG. 3B illustrating the immediate proximity of the plate terminating adjacent the edge of departing blades of the propeller.

Referring to FIGS. 3A and 3B, steering and adjustment of outdrive O relative to water can be understood. Hydraulic steering cylinders 30 are illustrated with transom T being omitted. Specifically, port steering cylinder 31, center cylinder 32, and starboard steering cylinder 33 are illustrated. Remembering that drive shaft 22 is on universal joint 24, it can be easily understood that by using hydraulic steering cylinder 30, both the adjustment of outdrive O in angle to water surface 14 and side-to-side steering angle can easily occur. Since the propeller and steering are essentially in the prior art, further description will not be provided.

Figure 2:
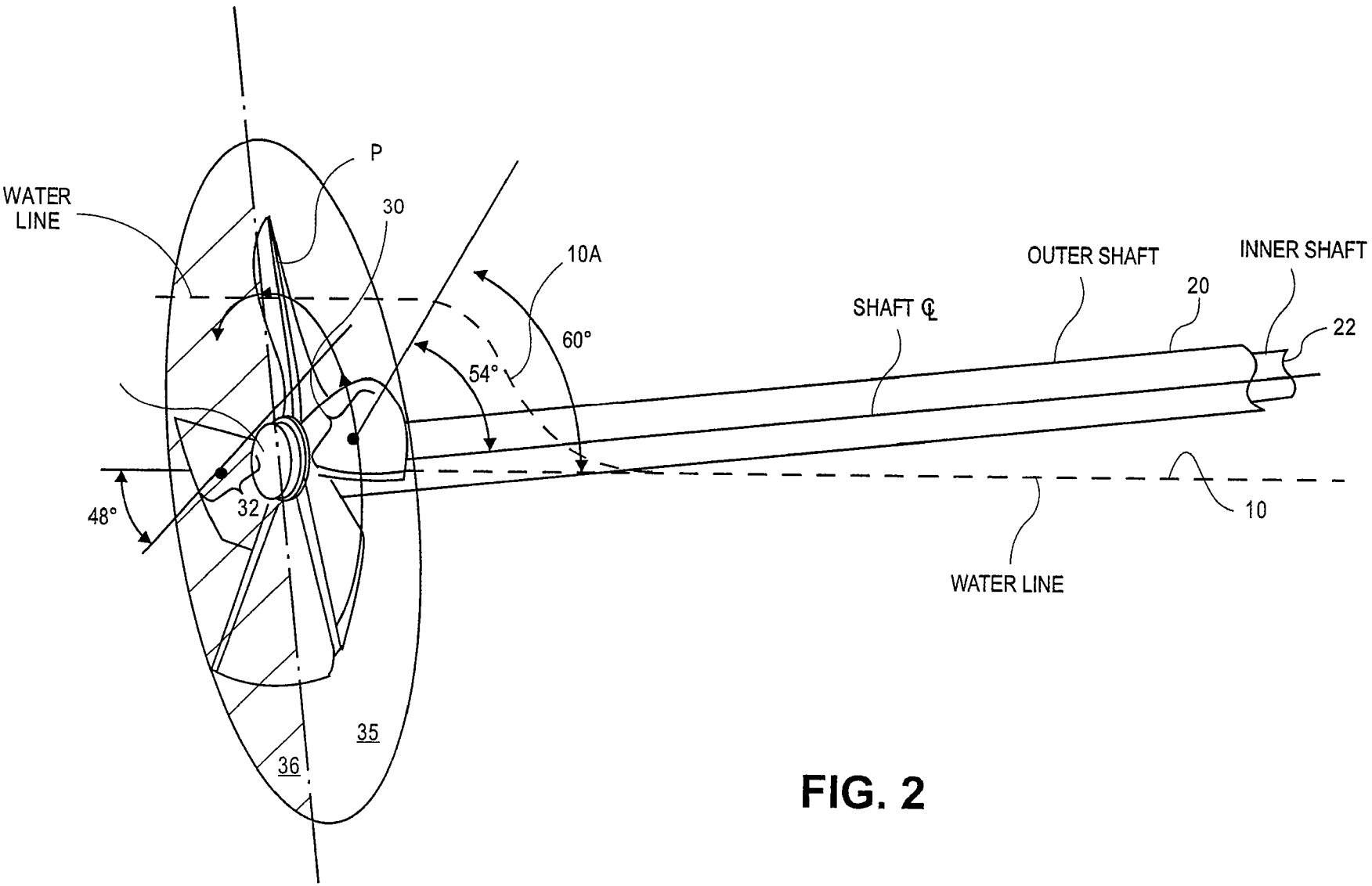
FIG. 2 is a schematic perspective view of an outdrive illustrating propeller blading and a working surface of that propeller blading relative to the inclined outdrive shaft, the entry portion of the propeller blading relative to the undisturbed water, and the departure portion of the propeller blading relative to the undisturbed water, with the increased water level on the departure portion of the propeller blading being schematically shown.

Having set forth the general configuration, attention now can be turned to FIG. 2. With FIG. 2, I will explain the variation of propeller pitch with respect to the propeller P.

Outdrive propeller P is typically immersed below the surface 10 of the water from the center of rotation 30 of the propeller to immerse just the lower half of the propeller within the water, presuming that the water is undisturbed. Shaft 22 of the propeller extends from the transom downward at a 6° angle with respect to surface 10 of the undisturbed water when the high speed planing hull is on plane. This has the beneficial result of keeping the most of the shaft 20, 22 of the outdrive out of the water. Typically, this angle can be from 6° to 12°. I will use 6° in the following examples.

The shaft of typical outdrive is typically of large diameter, here approximately 5 inches. It includes an outer tubular housing 20 and an inner rotating shaft 22 to supply rotational power to propeller P. Having the shaft extend from the transom of the boat, downward at an angle of 6° to 12° from the horizontal, the major part of the shaft and surrounding tubular member is kept from having to be dragged through the water. This saves considerable friction with respect to the water and this angular disposition of outdrives is universally used.

The propeller that I prefer to use is a 22 inch Rolla Propeller manufactured by the Rolla SP Propellers SA of Balerna, Switzerland. The blade is truncated to my order so that the original 22 inch diameter ends up being 15 inches. The propeller can be generically described as a "cleaver style" propeller. While other propellers will do, this propeller constitutes my preferred design.

In the following description, I am going to use the definition "working surface" to describe an arbitrarily selected portion of a propeller blade. I will select this arbitrary "working surface" 30 by measure radially outward of the blade of a propeller, here a 15 inch diameter propeller. The radial distance that I will choose is 5 inches. I will take measurement of the angle of the working surface tangent to the rotation of the propeller and with respect to the plane of the upper surface of the water including surface 10.

The reader will understand the reason for this arbitrary definition. Specifically, propeller blades have changing working blade angles from the hub of the propeller to the extremity of the blades. In the usual case, the pitch is high adjacent the hub and gradually decreases as that pitch is measured radially outward. By having a "working surface" 30 (pitch chosen on an arbitrary radial tangent to the direction of propeller rotation), it is possible to generate a convenient working definition of propeller pitch in angle with respect to the shaft. Using this definition, some of the working principles of this invention can be more easily understood.

I have discovered that the 6° downward disposition of the outdrive shaft has the effect of producing variable pitch propeller blading on opposite sides of the partially immersed propeller! Specifically, this may be seen by taking a representative "working surface" 30 on the surface of a propeller. Say on a 14 inch diameter propeller, this chosen "working surface" 30 happens to be in the middle of a propeller blade at a distance of 5 inches of radius from the center of rotation of a propeller having a 7 inch radius (or 14 inch diameter). Placing a level device along the "working surface" tangent to the direction of propeller rotation and measuring the angle of the "working surface" with respect to the outdrive shaft will yield a constant angle of the working surface with respect to the shaft. Say for example this angle is 54°. So at any position of rotation of the "working surface" 30 with respect to the shaft, this angle will always be the same, that is 54° with respect to a plane including the axis of the drive shaft of the propeller.

But everyone forgets that the propeller shaft itself is at an angle! That angle is illustrated here at 6° with respect to the plane of the undisturbed water when the boat is planing at high speed. I have discovered that this produces variable propeller pitch on opposite horizontal sides of the propeller! As these variable propeller pitches are integral to the shrouding that I place around my improved outdrive, the variable pitches must be understood.

As is well known, most single propellers rotate counterclockwise following the well known "right hand rule." By extending the right hand thumb in the direction of the propeller shaft, the fingers when naturally curled give the direction of rotation of the propeller. Thus it will be understood that in FIG. 2, I illustrate the more common right hand propeller.

Where two propellers are used, one propeller rotates counterclockwise and the other propeller clockwise. And since both type of propellers are always a possibility in an outdrive propeller, I choose to talk about the working surfaces 30 of the propeller entering the water and the working surfaces 30 of the propeller leaving the water, regardless of whether the propeller right or left hand rotation.

I have found the entry pitch of the working surface (angle of attack with respect to the plane of the passing undisturbed water) is increased upon entry into the water by the angle of the shaft with respect to the water. Similarly, the departure pitch of the working surface is decreased upon departure from the water by the angle of the shaft with respect to the water. This discovery is an important consideration in the design that follows.

Referring to FIG. 2, consider the case of the entry pitch of the working surface 30, this entry working surface 30 being toward the viewer in the perspective view of FIG. 2. As we have previously developed, the working surface has a 54° angle with respect to a plane including the propeller shaft. But the propeller shaft is inclined at 6°. Adding this 6° to 54°, the angle of attack of the entry pitch of the working surface with respect to the undisturbed water though which the propeller passes upon entry into the undisturbed water level now becomes 60°! This is illustrated in FIG. 2.

Consider the case of the departure pitch of the working surface 30. This working surface 32 is away from the viewer in the perspective view of FIG. 2. Again the working surface has a 54° angle with respect to the propeller shaft. But the propeller shaft is inclined at 6°. Subtracting this 6° from 54°, the angle of attack of the entry pitch of the working surface with respect to the undisturbed water through which the propeller blade passes upon departure from the undisturbed water level now becomes 48°!

The important thing to understand, is that with an outdrive having shaft inclined from the horizontal by a small angle (here 6°), the entry pitch of any working surface on a blade is higher that the departure pitch of any working surface on the blade by the value of the shaft inclination.

Now let us talk about the practical effect of the pitch change in the partially immersed outdrive propeller P. The entry half 35 of propeller P has higher pitch than the departure half 36 of the propeller! So at low speed and upon acceleration, the departure pitch of departure half 36 will be more ideal. Upon reaching higher speed, the entry pitch of the entry half 35 of propeller P will be more ideal.

Having discussed my discovery of the variable pitch of an outdrive propeller, discussion of my discoveries about the disturbance of water by a propeller proceeding through the water at high speed now become relevant. In summary, I have discovered that where a boat is proceeding at high speed—say 160 mph, standing water is disturbed before the blade of the propeller passes through the standing water. In other words, there is a disturbance in advance of blade entry to the surface of the water! There is a well known disturbance after the blade passes through the water; any person standing at the stern of a propeller driven vessel and observing its wake recognizes this disturbance. It is not well known that disturbance occurs in the direction of boat travel in advance of the passage of the propeller blades through the water!

First, it may well be that shock waves transmit in water faster than the high speed (e.g. 160 mph) passage of the boat.

Second, the variable pitch phenomena related to outdrives also has an effect. Consider the following.

In the usual case, the propeller is rotated to propel water at a considerably faster speed than actual passage of the boat through the water. The propeller has slippage with respect to the passing water that is essential to its propelling effect. Anyone who has observed the wake of a propeller propelled ship is familiar with this result.

Now consider the case of the outdrive of this invention. The entry side of the propeller has a higher pitch, driving the water at higher speed. The departure side of the propeller has lower pitch, driving the water at lower speed. In actual practical effect, both pitches will considerably exceed the rate of passage of the boat through the water. For example, where the boat is proceeding through the water at 160 mph, both the entry high pitch side 35 of the propeller and the departure low pitch side 36 of the propeller will drive water at speeds exceeding the speed of the boat.

But there will be another surprising effect. When the entry side of the propeller is compared to the departure side of the propeller; water build up in advance of the departure side of the propeller will be more pronounced than water build up in advance of the entry side of the propeller! I have illustrated this surface build up by the elevated waterline surface 10*a* shown with respect to departure half 36. Observing this illustration, it will be understood that the drive passes from left to right of the illustrated perspective. It will further be seen that I illustrate this build up well in advance of propeller P.

The reason for this water build up differential is directly related to the variable pitch between the departure and entry sides of the propeller. Specifically, since the departure side has lower pitch and moves water at the propeller more slowly, water buildup in advance of the departure of the partially immersed propeller blade will be greater. Similarly, since the entry side has higher pitch and moves water at the propeller more quickly, water buildup in advance of the entry of the partially immersed propeller blade will be lesser.

As will hereafter be understood with respect to FIGS. 3A, 3B and 3C, I use the greater buildup of water on the departure side of the propeller to advantage.

Referring to FIG. 3A, I illustrate in perspective a view of my new shrouded outdrive O. Specifically propeller P has bracket 42 mounted overlying cylindrical propeller shaft 20. Bracket 42 supports flat plate 40 immediately before propeller P. It will be seen that the underside of plate 40 is roughly parallel with the plane of the upper surface of the undisturbed surface of water which outdrive O should pass through. It will also be noted that plate 40 is above the plane of upper surface 10 of the water.

Regarding this elevated placement of the lower surface of plate 40, I place a horizontal barrier at approximately two thirds (⅔) of the propeller radius directly overlying the departure side of the partially immersed propeller. This has the effect of keeping the low pitch departure side of the propeller immersed in water for more efficient propulsion.

This effect can be understood upon returning to FIG. 2. Regarding the departure section 36 of propeller P, it will be remembered that waterline 10*a* rises in advance of the passage of outdrive O through the undisturbed water. This rising occurs until the bottom surface of plate 40 is encountered. The rising water is then confined below the surface of plate 40.

Returning to FIG. 3C and the side elevation there shown, another important aspect of plate 40 can be understood. Specifically, plate 40 terminates immediately ahead of the leading edge of propeller P. By immediately ahead, I use as little a distance as practicable. Separation is only maintained at a sufficient distance to assure that the trailing edge of plate 40 and the leading blade edges of propeller P do not physically interfere and that normal handling of the outdrive O does not bend or deflect either the propeller P or the plate 40 so as to cause interference.

It is important to note that plate 40 has a beneficial effect primarily on the departure side 36 of propeller P; plate 40 has no appreciable effect and is not required on entrance side 35 of plate 40. Here, however, plate 40 is part of mount 42 holding shroud S around propeller P. Thus, I choose to make plate 40 symmetrical.

Returning to FIGS. 3A and 3B, it will be seen that shroud S is mounted at the side to side extensions 44 from plate 40. Shroud S is invert and arcuate; it extends below, around and about propeller P. For purposes of boat control, shroud S includes skeg 50. Skeg 50 supplements the action of shroud S in maintain outdrive O on course through the water without torques being applied to boat steering.

I have found that shroud S being invert, arcuate extending below, around and adjacent partially submersed propeller P has the effect of defining a channel in the water as outdrive passes through that water at high speed. Specifically, shroud S prevents water circulation to the side of propeller P and assures that propeller P only drives water fore and aft of outdrive O. The disposition of a shroud under propeller P is not shown in my Arneson U.S. Pat. No. 5,667,415.

Figure 4:
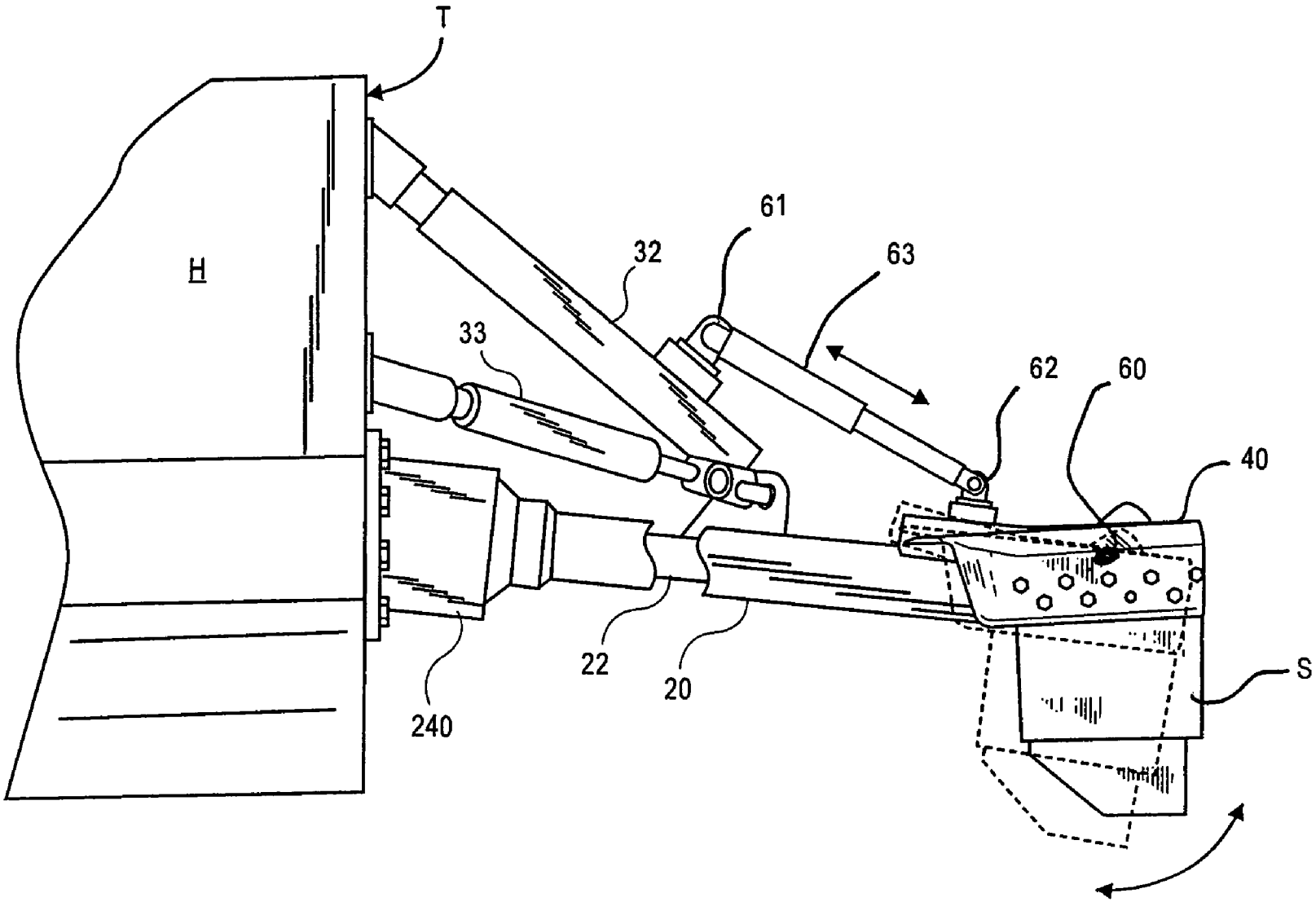
FIG. 4 is a perspective view of the outdrive of FIGS. 3A, 3B and 3C illustrating independent angular adjustment of the shroud relative to the rest of the outdrive.

Referring to FIG. 4, it will be seen that shroud S and plate 40 are pivotal about an axis 60 overlying propeller P (obscured from view). Hydraulic cylinder 63 extends between a first clevis 61 on cylinder 32 and a second clevis 62 on plate 40. It this way small adjustments can be made to the angle of plate 40 and shroud S. It is to be noted that for purposes of understanding I show a relatively great deflection in angle of plate 40 and shroud S; in actual fact this deflection can be quite small. In the usual case it is utilized to apply trim from the outdrive to the hull, for example by preventing the stern from being unduly lifted due to lift applied at the stern.

Figure 5A:
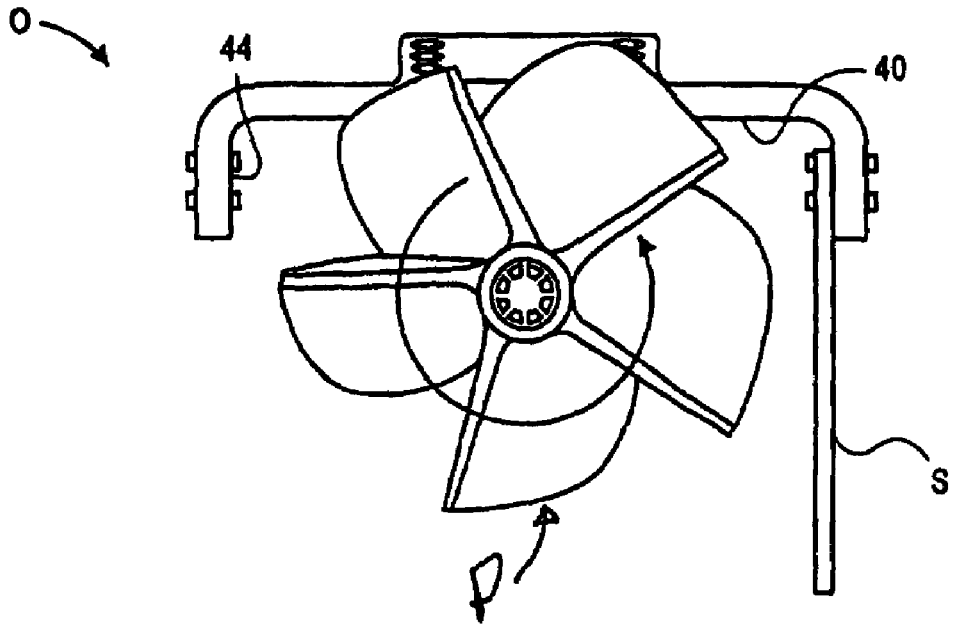
FIG. 5A is an embodiment of the outdrive with the inverted shroud omitted and only the plate producing the improved propulsion of this invention.

The reader will understand that there are two discrete parts to this disclosure. In FIG. 5A we show plate 40 functioning to keep the outgoing blading immersed in water for a greater dwell time in its total rotational cycle. This improves propulsion. It should be noted that I prefer a truncated shroud S for this embodiment that does not surround propeller P. In other words, plate 40 will be operable in the absence of a surrounding shroud S.

Figure 5B:
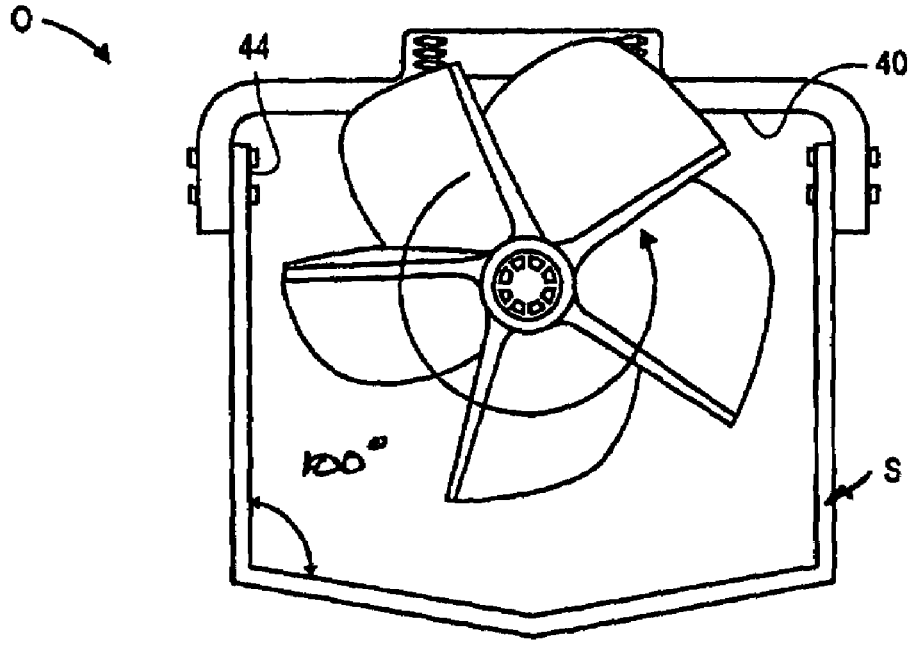
FIG. 5B illustrates the inverted shroud with a rectilinear profile.

Referring to FIG. 5B, it is emphasized that the inverted shroud S can be other than a smooth arc. For example, the shroud S is shown with angles of 100° utilized in squaring the rear elevation of the propeller.

Figure 5C:
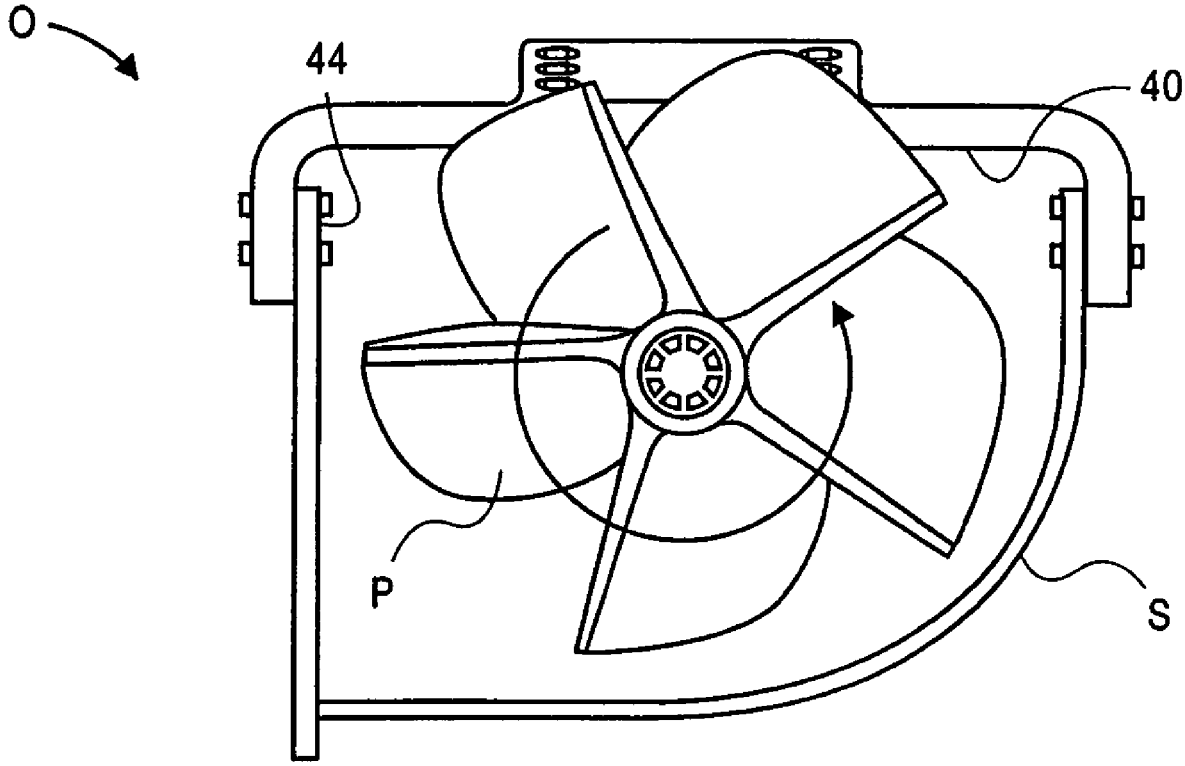
FIG. 5C illustrates the inverted shroud with one side curved and the opposite side linear.

Referring to FIG. 5C, an inverted shroud S is sown having a curvilinear starboard side with a linear port side. Curvilinear starboard side enables outgoing propeller blading to cooperate with shroud S in raising water to plate 40.

The reader will understand that plate 40 and shroud S will admit of variation. However, so long as plate 40 creates additional dwell time of the departing blades within a passing water stream, the function of plate 40 will be practiced. Further, so long as shroud S provides an isolated channel for operation of the outdrive without extraneous torques being introduced to the propelled hull, this section of the invention will be practiced.

What is claimed is:

1. In a marine outdrive for a boat, the boat having
a transom,
a propeller shaft extending downward at an angle from the horizontal with respect to the transom,
a propeller having a center of rotation on the shaft,
a shroud disposed along a path immediately about the propeller,
a mount extending from the boat for the shroud holding the shroud about the propeller,
the improvement to the mount and shroud comprising:
the mount holding the shroud with the shroud being disposed below, around, and adjacent the propeller whereby the shroud forms a channel below, around, and adjacent the propeller to isolate water flow within the channel from water flow to the sides of the channel, and further wherein:
the mount includes a flat plate mounted at a distance overlying the center of rotation of the propeller shaft with an upper portion of the propeller rotating above the lower surface of the plate and,
the plate has a boarder terminating immediately adjacent to departing propeller blades from a water line taken relative to the boat whereby water accumulated by departing propeller blades is accumulated to and confined below the plate.

2. The improvement in a marine outdrive for a boat according to claim 1 and further wherein:
the plate is independently adjustable in angle with respect to the propeller.

3. The improvement in a marine outdrive for a boat according to claim 1 and further wherein:
the shroud is independently adjustable in angle with respect to the propeller.

4. In a marine outdrive for a boat, the boat having
a transom,
a propeller shaft,
a propeller having a center of rotation on the shaft,
a shroud disposed along a path immediately about the propeller, and
a mount extending from the boat for the shroud holding the shroud about the propeller,
the improvement to the mount and shroud comprising:
the mount including a flat plate mounted at a distance overlying the center of rotation of the propeller shaft with a departing portion of the propeller rotating above the lower surface of the plate, and,
the plate having a boarder terminating immediately adjacent to departing propeller blades from a water line taken relative to the boat whereby water accumulated by departing propeller blades is accumulated to and confined below the plate.

5. The improvement in a marine outdrive according to claim 4 and further wherein:
the mount holds the shroud with the shroud being disposed below, around, and adjacent the propeller whereby the shroud forms a channel below, around, and adjacent the propeller to isolate water flow within the channel from water flow to the sides of the channel.

6. The improvement in a marine outdrive according to claim 5 and further wherein:
the shroud is independently adjustable in angle with respect to the propeller.

7. The improvement in a marine outdrive according to claim 4 and further wherein:
the plate is independently adjustable in angle with respect to the propeller.

8. A marine outdrive for mounting to a boat transom, the boat having a hull for high speed floating passage on the surface of water, the marine outdrive comprising:
a tubular propeller shaft extending from the boat transom into the water,
a shaft within the tubular propeller shaft,
a propeller mounted to the shaft for partial immersion in the water whereby a lower portion of the propeller passes below and into the water during high speed floating passage of the boat and an upper portion of the propeller passes above the water during high speed floating passage of the boat,
a shroud in an invert arcuate configuration with curvature of the shroud being disposed immediately below the water and adjacent the propeller,
a mount for the shroud holding the shroud around, under and about the propeller whereby the propeller operates within a shroud enclosed channel during high speed passage of the boat through the water, and wherein:
the mount includes a flat plate mounted at a distance overlying the center of rotation of the propeller shaft with a departing portion of the propeller rotating above the lower surface of the plate, and,
the plate has a boarder terminating immediately adjacent to departing propeller blades from a water line taken relative to the boat whereby water accumulated by departing propeller blades is accumulated to and confined below the plate.

9. The marine outdrive for mounting to a boat transom according to claim 8 and wherein:
the shroud is independently controllable in angle with respect to the propeller.

10. The marine outdrive for mounting to a boat transom according to claim 8 and wherein:
the plate is independently controllable in angle with respect to the propeller.

11. A marine outdrive for mounting to a boat transom, the boat having a hull for high speed floating passage on the surface of water, the marine outdrive comprising:
a tubular propeller shaft extending from the boat transom into the water,
a shaft within the tubular propeller shaft,
a propeller mounted to the shaft for partial immersion in the water whereby a lower portion of the propeller passes below and into the water during high speed floating passage of the boat and a upper portion of the propeller passes above the water during high speed floating passage of the boat,
a shroud being disposed immediately below the water and adjacent the propeller,
a flat plate mounted at a distance overlying the center of rotation of the propeller shaft with an upper portion of the propeller rotating above the lower surface of the plate,
the plate having a boarder terminating immediately adjacent to departing propeller blades from a water line taken relative to the boat whereby water accumulated by departing propeller blades is accumulated to and confined below the plate, wherein:
the shroud is about, around and below the propeller.

12. The marine outdrive for mounting to a boat transom according to claim 11 and wherein:
the plate is independently controllable in angle with respect to the propeller.

13. The marine outdrive for mounting to a boat transom according to claim 11 and wherein:

the shroud is independently controllable in angle with respect to the propeller.

14. A high speed boat comprising in combination:

a hull for high speed passage through water;

the hull having at least one bow at the forward end and at least one transom at the stern;

a tubular propeller shaft extending from the boat transom into the water;

a shaft within the tubular propeller shaft;

a propeller mounted to the shaft for partial immersion in the water whereby a lower portion of the propeller passes below and into the water during high speed floating passage of the boat and a upper portion of the propeller passes above the water during high speed floating passage of the boat;

a shroud adjacent the propeller;

a mount for holding the shroud; and, the mount including a flat plate mounted at a distance overlying the center of rotation of the propeller shaft with a departing portion of the propeller rotating above the lower surface of the plate; and, the plate having a boarder terminating immediately adjacent to departing propeller blades from a water line taken relative to the boat whereby water accumulated by departing propeller blades is accumulated to and confined below the plate.

* * * * *